US011332346B2

(12) United States Patent
Montigny et al.

(10) Patent No.: US 11,332,346 B2
(45) Date of Patent: May 17, 2022

(54) ELEVATOR LANDING DOOR UNLOCKING SYSTEM

(71) Applicant: Otis Elevator Company, Farmington, CT (US)

(72) Inventors: Guillaume Montigny, Gien (FR); Sebastien Fougeron, Lorris (FR); Amine Badaoui, Briare (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 279 days.

(21) Appl. No.: 16/593,434

(22) Filed: Oct. 4, 2019

(65) Prior Publication Data

US 2020/0115192 A1 Apr. 16, 2020

(30) Foreign Application Priority Data

Oct. 12, 2018 (EP) ..... 18306347

(51) Int. Cl.
*B66B 13/20* (2006.01)
*B66B 13/12* (2006.01)
*B66B 13/30* (2006.01)

(52) U.S. Cl.
CPC ..... *B66B 13/20* (2013.01); *B66B 13/12* (2013.01); *B66B 13/30* (2013.01)

(58) Field of Classification Search
CPC ..... B66B 13/12; B66B 13/20
See application file for complete search history.

(56) References Cited

U.S. PATENT DOCUMENTS

| | | | |
|---|---|---|---|
| 4,364,454 | A | 12/1982 | Glaser et al. |
| 6,508,332 | B2 | 1/2003 | Fahl et al. |
| 6,591,946 | B2 | 7/2003 | Launch |
| 7,350,623 | B2 | 4/2008 | Kinoshita et al. |
| 7,398,862 | B2 | 7/2008 | Dziwak |
| 9,656,835 | B2 | 5/2017 | Kitazawa |
| 9,834,413 | B2 | 12/2017 | Mittermayr |

(Continued)

FOREIGN PATENT DOCUMENTS

| | | | |
|---|---|---|---|
| CN | 1922093 | A | 2/2007 |
| CN | 102020176 | A | 4/2011 |

(Continued)

OTHER PUBLICATIONS

Machine Translation of DE 29508499.*

(Continued)

*Primary Examiner* — Diem M Tran
(74) *Attorney, Agent, or Firm* — Cantor Colburn LLP

(57) ABSTRACT

Elevator door coupling systems are described. The systems include a car door lock having a coupling element and a lock element, the lock element operably connected to a latch for locking the car door lock and a landing door lock having a movable plate, a first contact element mounted to the movable plate and configured to engage with the coupling element and a second contact element configured to engage with the lock element. In operation, the coupling element is operable to apply force to the first contact element and cause the movable plate to rotate and as the movable plate rotates, the second contact element applies force to the lock element to urge the latch from a locked position to an unlocked position.

13 Claims, 7 Drawing Sheets

(56) References Cited

U.S. PATENT DOCUMENTS

| | | | | |
|---|---|---|---|---|
| 2004/0079593 | A1 | 4/2004 | Karner et al. | |
| 2008/0000727 | A1 | 1/2008 | Dziwak | |
| 2008/0078628 | A1 * | 4/2008 | Christen | B66B 13/20 187/319 |

FOREIGN PATENT DOCUMENTS

| | | | | |
|---|---|---|---|---|
| CN | 102070065 | A | | 5/2011 |
| CN | 103562116 | A | | 2/2014 |
| CN | 103827011 | A | | 5/2014 |
| CN | 104386564 | A | | 3/2015 |
| CN | 104692220 | A | | 6/2015 |
| CN | 104773636 | A | | 7/2015 |
| CN | 105035921 | A | | 11/2015 |
| CN | 105392730 | A | | 3/2016 |
| CN | 105565126 | A | | 5/2016 |
| CN | 104555673 | B | | 8/2016 |
| CN | 105947852 | A | | 9/2016 |
| CN | 106687405 | A | | 5/2017 |
| CN | 106744199 | A | | 5/2017 |
| CN | 105731229 | B | | 9/2017 |
| DE | 29508499 | U1 | * | 11/1996 |
| EP | 0634353 | A2 | | 1/1995 |
| EP | 0892756 | A1 | | 1/1999 |
| EP | 1331193 | A1 | | 7/2003 |
| EP | 1366258 | B1 | | 12/2003 |
| EP | 1500625 | A1 | * | 1/2005 |
| EP | 1659084 | A2 | * | 5/2006 |
| EP | 1820767 | A1 | | 8/2007 |
| EP | 2695843 | A1 | | 2/2014 |
| EP | 2157040 | B1 | | 1/2015 |
| FR | 2421134 | A1 | | 10/1979 |
| FR | 2827266 | A1 | | 1/2003 |
| JP | 4839593 | B2 | | 12/2011 |
| JP | 2012116599 | A | * | 6/2012 |
| JP | 2012218834 | A | | 11/2012 |
| JP | 2013103780 | A | | 5/2013 |
| KR | 20070018889 | A | * | 2/2007 |
| KR | 20130120984 | A | * | 11/2013 |
| WO | WO-2008078135 | A1 | * | 7/2008 |
| WO | 2011043378 | A1 | | 4/2011 |
| WO | 2015140652 | A1 | | 9/2015 |

OTHER PUBLICATIONS

European Office Action for European Application No. 18306347.8, International Filing Date Oct. 12, 2018, dated Aug. 28, 2020, 6 pages.

European Search Report for European Application No. 18306347.8, International Filing Date Oct. 12, 2018, dated Apr. 15, 2019, 7 pages.

* cited by examiner

ELEVATOR LANDING DOOR UNLOCKING SYSTEM

CROSS REFERENCE TO RELATED APPLICATIONS

This application claims the benefit of European Application No. 18306347.8, filed Oct. 12, 2018, which is incorporated herein by reference in its entirety.

BACKGROUND

The subject matter disclosed herein generally relates to elevator systems and, more particularly, to systems for unlocking elevator landing doors.

In a typical elevator or lift installation, a vertically moving elevator car can be positioned at one of a number of landing floors so as to align elevator car doors with corresponding landing doors located at one of the landings. Modem installations typically have one or more horizontally sliding elevator car doors and at least one sliding landing door located at each of the landing floors, all of which remain closed during movement of the elevator car.

Upon arrival of the elevator car at a landing, a door opening mechanism is activated which drives the elevator car door horizontally to open the elevator car door. In typical installations, a door coupling employing one or more vanes projecting from the surface of the elevator car door in the direction of the adjacent landing door engages various structures of the landing door. For example vanes, rollers, or other protrusions can be configured to project from the landing door to enable engagement and/or coupling between the elevator car door and the landing door. Through the engagement and/or coupling, the elevator car door drives the landing door horizontally open. As such, passengers can enter or exit the elevator car.

Elevator codes and regulations may require that the landing doors remain locked and fastened securely to prevent opening and thereby prevent unauthorized opening unless an elevator car is positioned directly adjacent the landing (e.g., engagement/coupling of doors). Further, elevator car doors may be required to remain latched against manual movement unless the elevator car is positioned at a landing, and the doors are aligned (e.g., detected alignment) and/or engaged/coupled. Various mechanisms and systems have been employed to secure and unsecure landing and elevator car doors.

SUMMARY

According to some embodiments, elevator door coupling systems are provided. The elevator door coupling systems include a car door lock having a coupling element and a lock element, the lock element operably connected to a latch for locking the car door lock and a landing door lock having a movable plate, a first contact element mounted to the movable plate and configured to engage with the coupling element and a second contact element configured to engage with the lock element. In operation, the coupling element is operable to apply force to the first contact element and cause the movable plate to rotate and as the movable plate rotates, the second contact element applies force to the lock element to urge the latch from a locked position to an unlocked position.

In addition to one or more of the features described above, or as an alternative, further embodiments of the elevator door coupling systems may include a car lock support, wherein the coupling element is pivotably mounted to the car lock support by at least one first movable mount and the lock element is pivotably mounted to the car lock support by at least one second movable mount.

In addition to one or more of the features described above, or as an alternative, further embodiments of the elevator door coupling systems may include that the car door lock further includes a deterrent element arranged to prevent unauthorized or improper operation of the car door lock.

In addition to one or more of the features described above, or as an alternative, further embodiments of the elevator door coupling systems may include that the landing door lock further includes a landing door latch for locking the landing door lock.

In addition to one or more of the features described above, or as an alternative, further embodiments of the elevator door coupling systems may include that the movable plate includes an extension arm, wherein the second contact element is located on the extension arm.

In addition to one or more of the features described above, or as an alternative, further embodiments of the elevator door coupling systems may include an unlocking screw located on the extension arm.

In addition to one or more of the features described above, or as an alternative, further embodiments of the elevator door coupling systems may include at least one position sensor operably connected to at least one of the car door lock and the landing door lock.

In addition to one or more of the features described above, or as an alternative, further embodiments of the elevator door coupling systems may include that the first contact element is a first roller and the second contact element is a second roller.

In addition to one or more of the features described above, or as an alternative, further embodiments of the elevator door coupling systems may include that the first roller is larger than the second roller.

In addition to one or more of the features described above, or as an alternative, further embodiments of the elevator door coupling systems may include that the lock element is maintained in a locked state by operation of gravity unless acted upon by the second contact element.

In addition to one or more of the features described above, or as an alternative, further embodiments of the elevator door coupling systems may include a landing lock support, wherein the landing door lock is mounted to the landing lock support, and the landing lock support is mountable to a frame of a landing door of an elevator system.

In some embodiments, an elevator system is provided that includes an elevator car located within an elevator shaft, a landing having a landing door openable on the elevator shaft, and an elevator door coupling system in accordance with one or more of the features described above.

In addition to one or more of the features described above, or as an alternative, further embodiments of the elevator systems may include that the elevator shaft comprises a plurality of additional landings, wherein each additional landing comprises a respective landing door lock.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
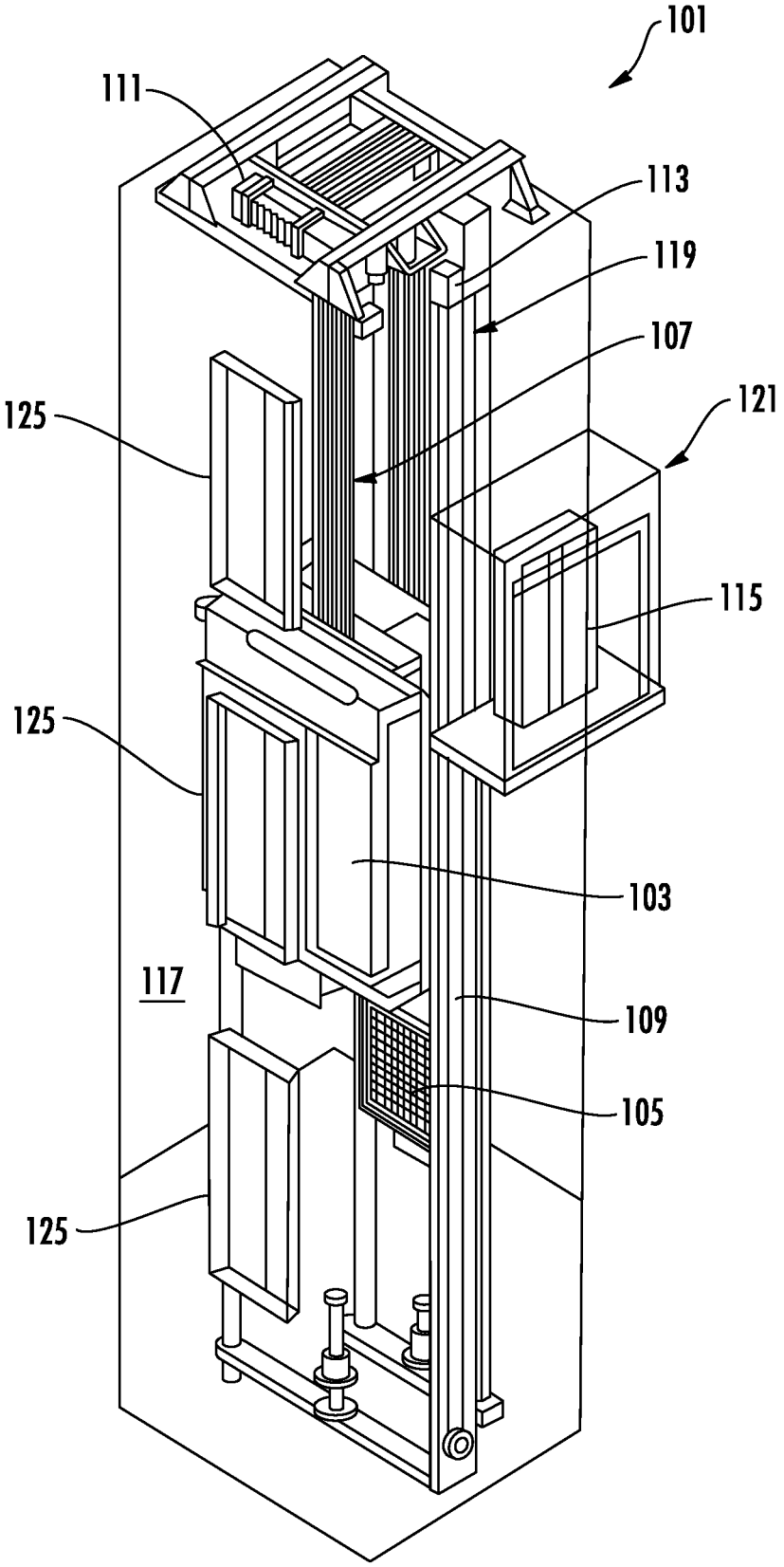
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and an elevator controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109. As used herein, the term "traveling component" refers to either of the elevator car 103 or the counterweight 105.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. The position reference system 113 and/or a safety system can include a speed-governor system 119, as will be appreciated by those of skill in the art. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101 and/or in a distributed networking system (e.g., internet or cloud-based). In some embodiments, the elevator controller 115 can be configured to control features within the elevator car 103, including, but not limited to, lighting, display screens, music, spoken audio words, etc.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2A:
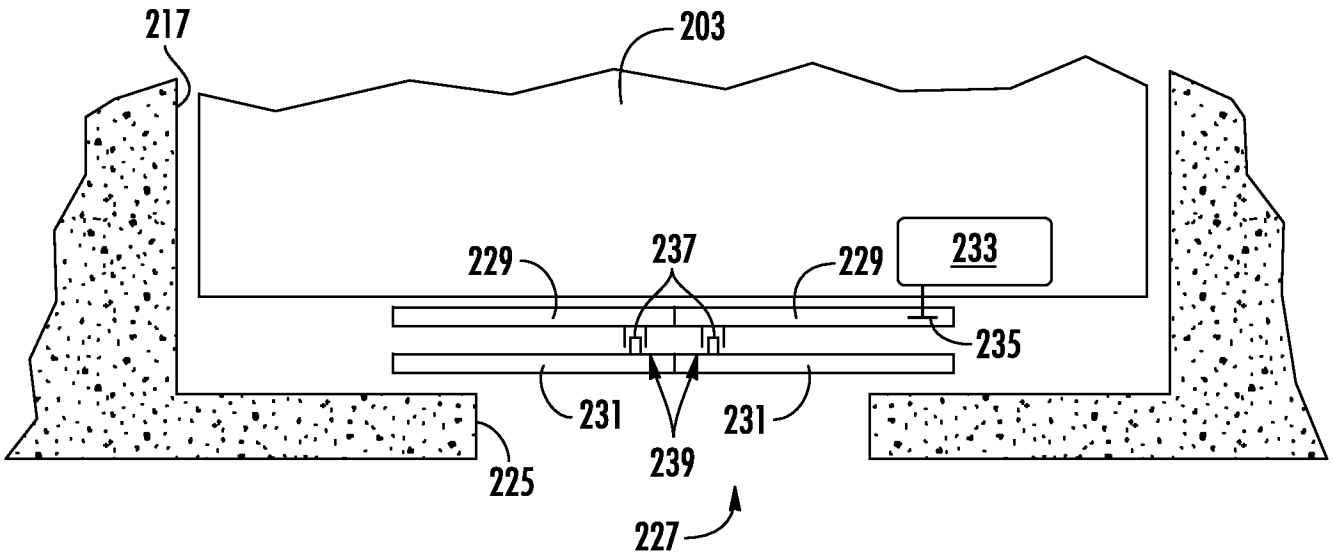
FIG. 2A is a schematic, partial plan view of an elevator car in an elevator shaft with elevator car doors and landing doors in a closed position, that may incorporate embodiments of the present disclosure.
Figure 2B:
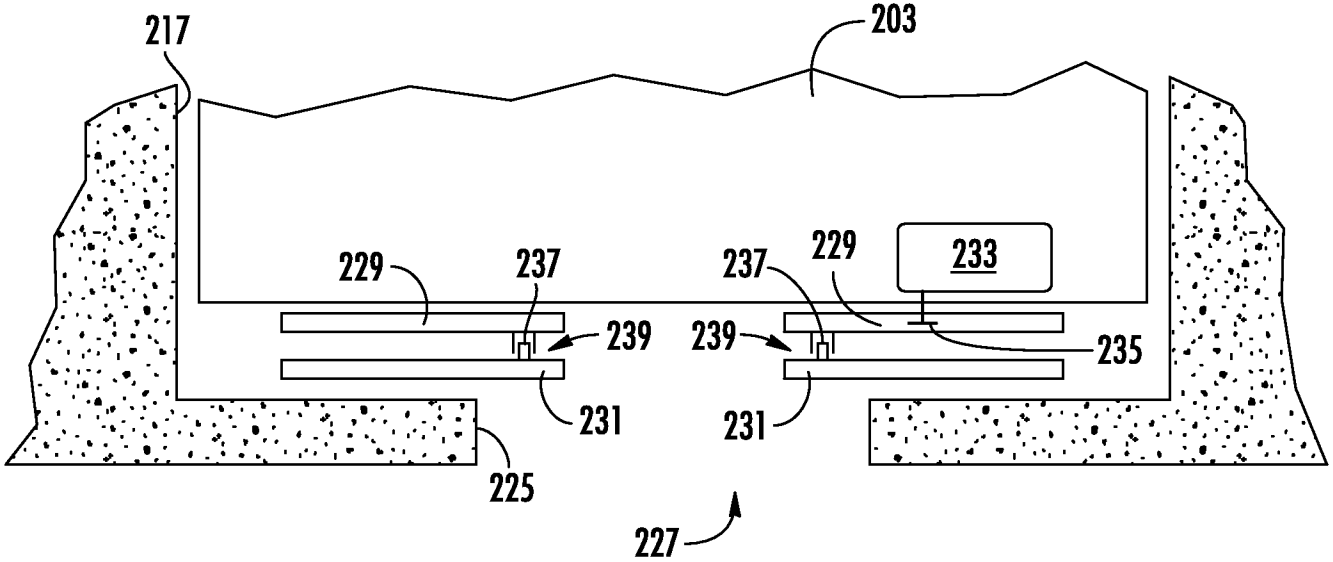
FIG. 2B is a schematic illustration of the elevator car and landing doors of FIG. 2A shown in an open position, that may incorporate embodiments of the present disclosure.

Turning to FIGS. 2A-2B, partial plan view illustrations of operation of elevator doors of an elevator system are shown. In FIGS. 2A-2B, an elevator car 203 is located within an elevator shaft 217 and positioned within the elevator shaft 217 in alignment with an opening 227 at a landing 225. As shown, elevator car doors 229 are aligned with landing doors 231 at the landing 225. The elevator car doors 229 are operated and actuated by a door operator 233. The door operator 233 can be arranged in operable communication with a controller (e.g., elevator controller 115). The door operator 233, in the present embodiment, is shown located atop the elevator car 203, although other locations of the door operator 233 can be employed without departing from the scope of the present disclosure. The door operator 233 includes a drive mechanism 235, such as a belt or chain operably driven by a motor or other device. FIG. 2A illustrates the elevator car doors 229 and the landing doors 231 in a closed position. FIG. 2B illustrates the elevator car doors 229 and the landing doors 231 in a partially opened position.

As shown in FIGS. 2A-2B, with the elevator car 203 located at the landing 225, each elevator car door 229 is coupled to a respective landing door 231 by an elevator car door coupling 239 that is part of or mounted to the respective elevator car door 229. Each elevator car door coupling 239 engages with and couples to a corresponding landing door coupling 237. As will be appreciated by those of skill in the art, the landing door couplings 237 can be configured as protrusions or other structures that are designed to engage with the elevator car door couplings 239. The landing door couplings 237, for example, can be raised bosses, bumpers, rods, rollers, etc., that are configured to act upon and move the respective landing door 231 concurrently with operation of the elevator car doors 229 through engagement of the couplings 237, 239. As will be appreciated by those skilled in the art, it is desirable that the elevator car door coupling 239 firmly/tightly grip a respective landing door coupling 237 when the elevator car door 229 and the landing door 231 are operated (e.g., opened/closed simultaneously). Furthermore, it is desirable that the elevator car door coupling 239 completely release the respective landing door coupling 237 and maintain sufficient running clearance as the elevator car 203 moves vertically through the elevator shaft 217. The elevator car door coupling 239 is configured to operate only when it has been determined that the elevator car 203 is positioned within a landing door zone, adjacent a respective landing door 231 at a landing 225.

Figure 3B:
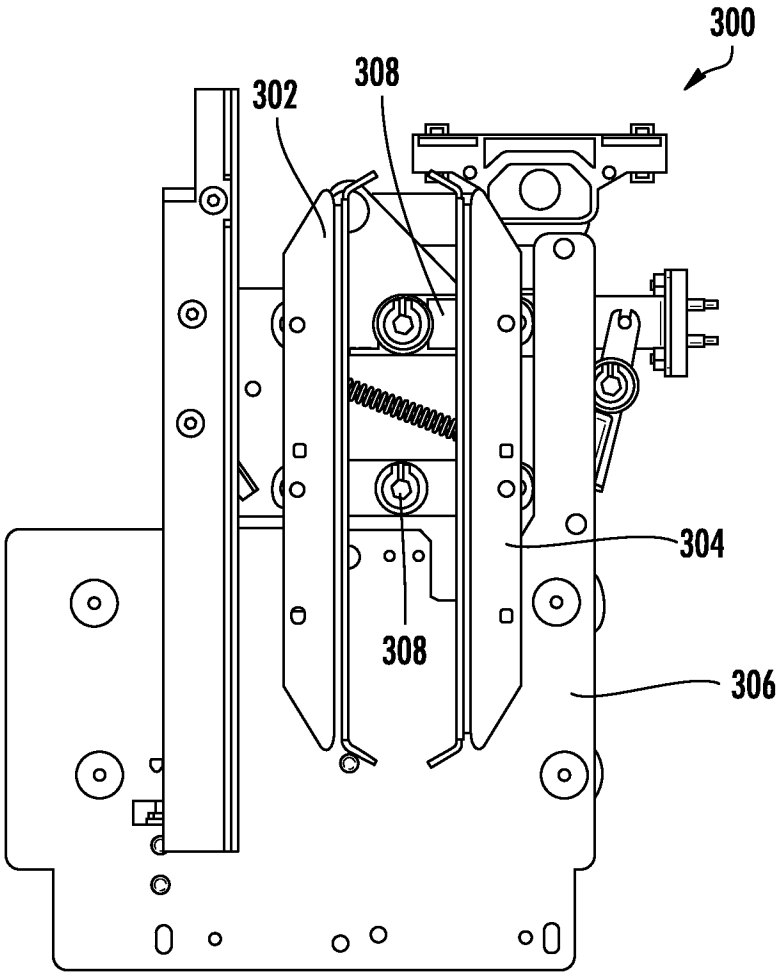
FIG. 3B (PRIOR ART)
FIG. 3B is a schematic illustration of the elevator car door coupling of FIG. 3A in an open state.
Figure 3A:
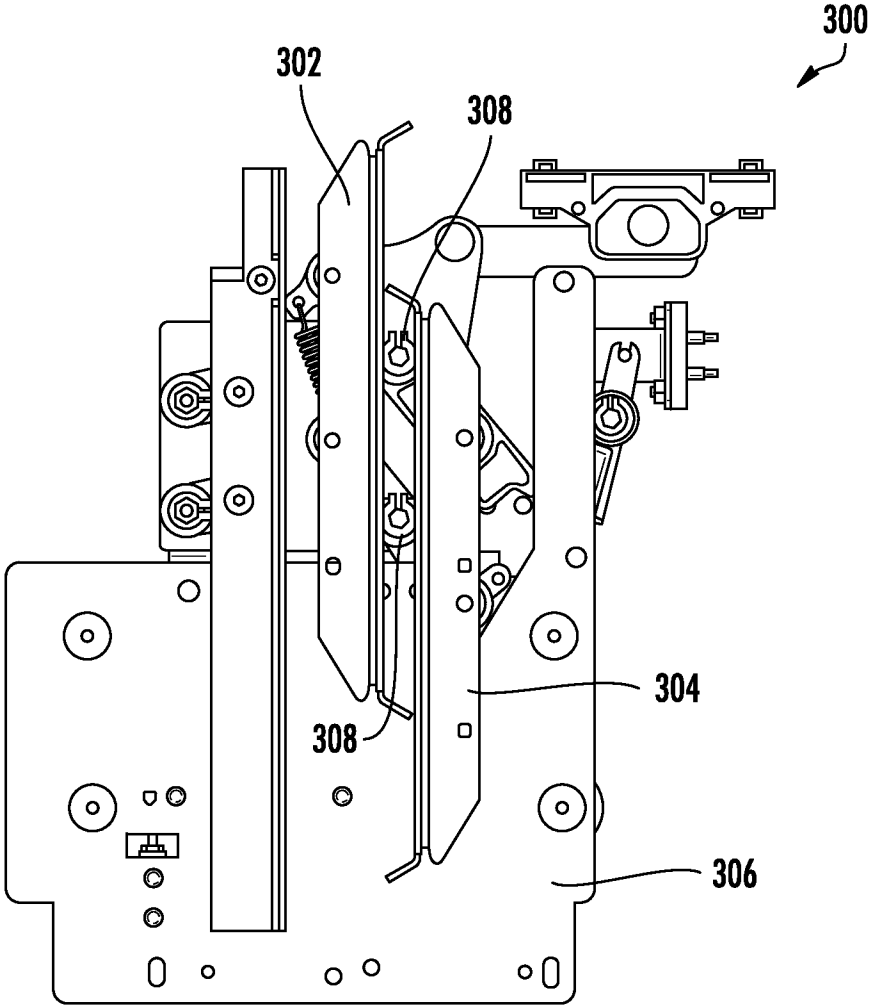
FIG. 3A (PRIOR ART)
FIG. 3A is a schematic illustration of a typical elevator car door coupling shown in a closed state.

Turning now to FIGS. 3A-3B, schematic illustrations of an elevator car door coupling 300 are shown, with FIG. 3A illustrating a closed position and FIG. 3B illustrating an open position. The elevator car door coupling 300 is mounted to an exterior surface of an elevator car door and travels with the elevator car as the elevator car moves within an elevator shaft. The elevator car door coupling 300 is engageable with a landing door coupling (not shown), and, when engaged, enables opening of the elevator car doors and the landing doors (e.g., as shown in FIGS. 2A-2B). When the elevator car is traveling within the elevator shaft, the elevator car door coupling 300 is in the closed position (FIG. 3A) and is configured to prevent contact between the elevator car door coupling 300 and landing door couplings located at each landing.

FIGS. 3A-3B illustrate the elevator car door coupling 300 as it would appear viewed in elevation when a corresponding elevator car door is in the fully closed position. The elevator car door coupling 300, as shown, includes a first vane 302 and a second vane 304. The first and second vanes 302, 304 are positioned proximate rollers of a landing door coupling when the landing door is also fully closed and the elevator car is located at a landing, as will be appreciated by those of skill in the art. The first and second vanes 302, 304 are movable relative to a support 306 mounted to the elevator car. The first and second vanes 302, 304 are movable about a pair of pivoting links 308.

When disposed in the orientation as shown in FIG. 3A (closed position), the elevator car door coupling 300 permits vertical movement of the elevator car within the elevator shaft without interference with the landing door couplings. That is, the first and second vanes 302, 304 are positioned such that rollers or other elements of the landing door couplings of the landings may be passed easily without danger of interference or contact.

In contrast, FIG. 3B illustrates the elevator car door coupling 300 as it appears during normal opening operation of an elevator car door when positioned relative to a landing door (e.g., coupled to a landing door coupling). As can be seen in FIG. 3B (as compared to FIG. 3A), the first and second vanes 302, 304 are moved away from each other and will contact rollers of a landing door coupling (not shown), as known in the art.

The typical elevator car door coupling may be overly large for certain applications, and thus a more compact or lower profile elevator car door coupling may be advantageous. For example, the elevator car door coupling 300 includes both first and second vanes 302, 304 (or blades) that are engageable with rollers to operate simultaneously or in concert. That is, the first and second vanes 302, 304 are operably connected such that when one of the first and second vanes 302, 304 moves, the other of the first and second vanes 302, 304 also moves. Such systems may be overly large or complex. Accordingly, embodiments of the present disclosure are directed to elevator car door coupling that employ a single first coupling blade that is engageable with a roller to operate the door and a single second coupling blade to lock/unlock the elevator car door. Thus, a typical two-vane or two-blade configuration may be eliminated.

To achieve this coupling configuration, in accordance with embodiments of the present disclosure, a landing door coupling includes a first contact element (e.g., a roller, rotating or pivoting pad, non-frictional element, friction reduced materials, etc., and/or combinations thereof) and a second contact element (e.g., a roller, rotating or pivoting pad, non-frictional element, friction reduced materials, etc., and/or combinations thereof). In some embodiments the first contact element may be a relatively large roller and the second contact element may be a relatively small roller. Such configuration may be in contrast to the two relatively large rollers that are typically employed, as will be appreciated by those of skill in the art. When an elevator car is located at a landing, e.g., within a door zone, the first contact element is configured to engage with the first blade and unlock the landing door. The second contact element is configured to push upon the second blade to enable the unlocking of a car door locking mechanism. That is, in accordance with embodiments of the present disclosure, the operation of the coupling elements of the landing door (e.g., the blades/vanes) is independent of each other. In other embodiments, the first and second contact elements may be the same size, either both relatively small or both relatively large. In embodiments incorporating one or more small rollers as the contact elements, the reduction in roller size may enable reduced total size or occupied volume of the elevator system door couplings.

Figure 4A:
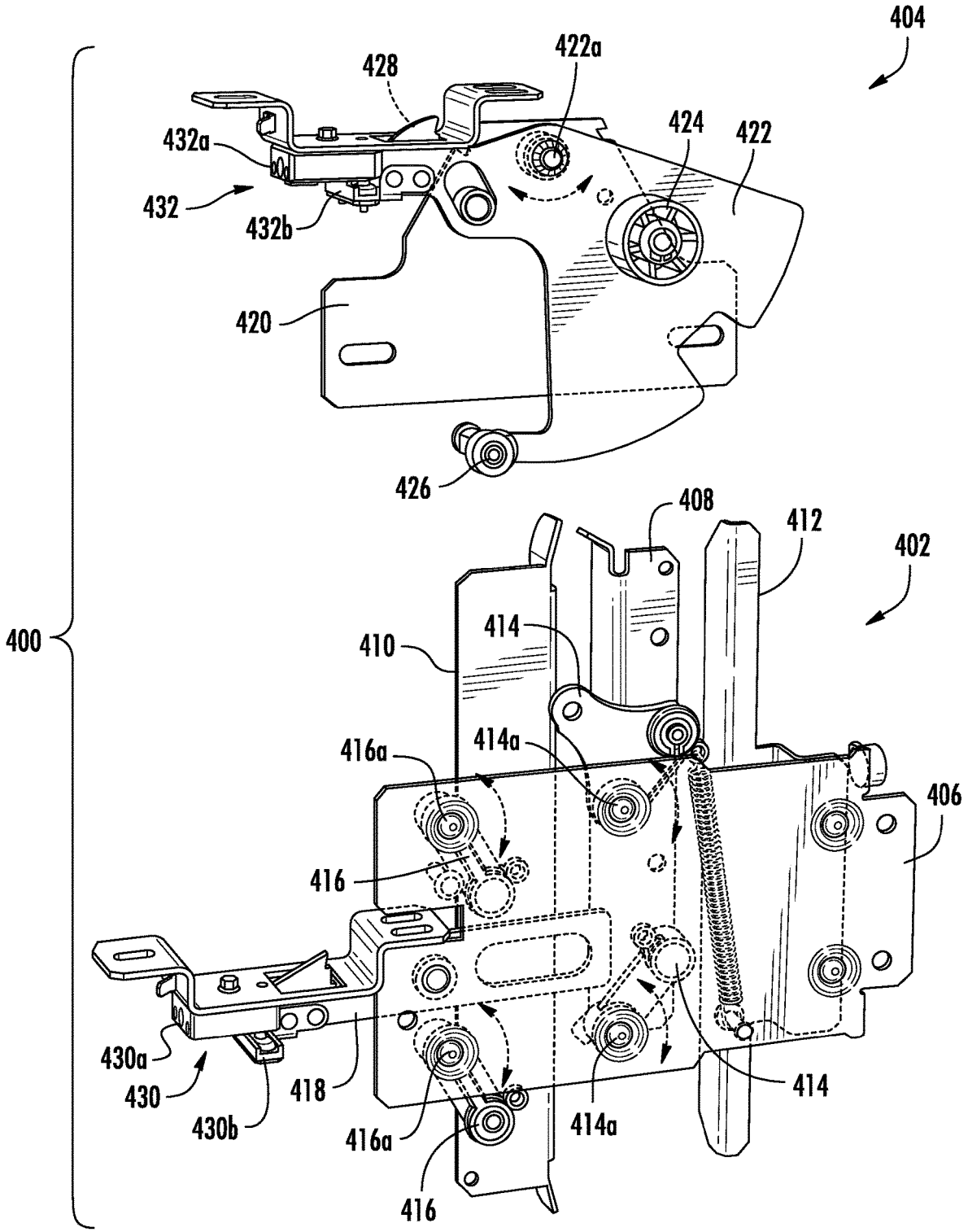
FIG. 4A is a schematic illustration of an elevator door coupling system in accordance with an embodiment of the present disclosure shown in a closed state.
Figure 4B:
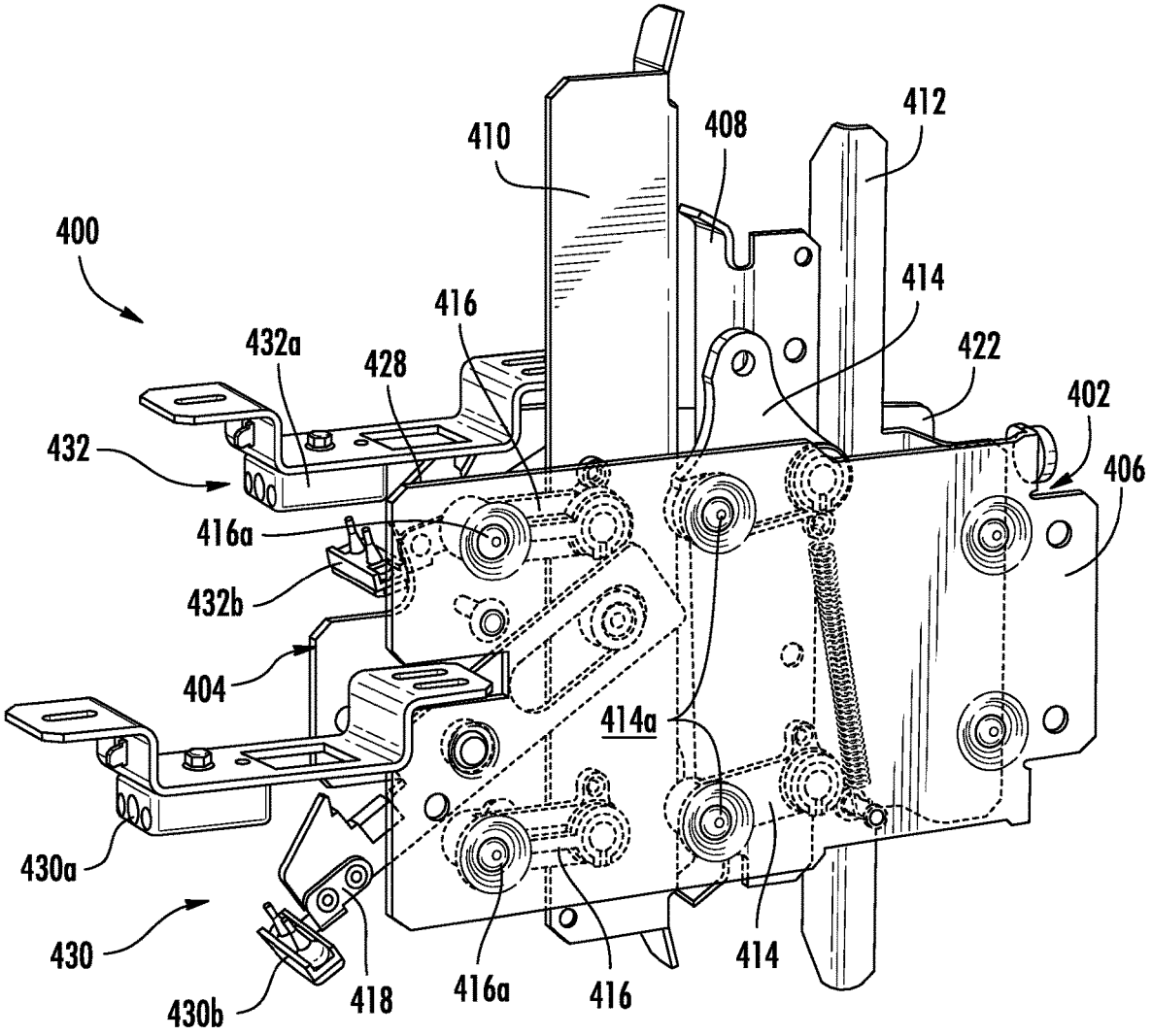
FIG. 4B is a schematic illustration of the elevator door coupling system of FIG. 4A in an open state.

Turning now to FIGS. 4A-4B, schematic illustrations of an elevator door coupling system 400 in accordance with an embodiment of the present disclosure are shown. The elevator door coupling system 400 includes an elevator car door lock 402 and a landing door lock 404. A car lock support 406 is configured to enable mounting of the elevator car door lock 402 to an elevator car. The landing door lock 404 may be mounted to a landing door lintel or other structural support and operably connected to a landing door of the elevator system. FIG. 4A illustrates the elevator car door lock 402 and the landing door lock 404 in locked states (with the components separated from each other). FIG. 4B illustrates the elevator car door lock 402 engaged with the landing door lock 404 and in unlocked states.

The elevator car door lock 402 includes a coupling element 408, a lock element 410, and a deterrent element 412. The coupling element 408 is moveable about one or more first movable mounts 414, which rotate about respective first pivots 414*a*. The first movable mounts 414 are mounted to the car lock support 406 so that the coupling element 408 is movable relative to the car lock support 406, about the first pivots 414*a*. Further, in some embodiments, one of the first movable mounts 414 may be configured to engage with a door belt or other similar door operating element, as will be appreciated by those of skill in the art. The lock element 410 is moveable about one or more second movable mounts 416, which are movable about respective second pivots 416*a*. The second movable mounts 416 are mounted to the car lock support 406 so that the lock element 408 is movable relative to the car lock support 406 about the second pivots 416*a*. The deterrent element 412 is fixedly connected to the car lock support 406 and is arranged to prevent unauthorized or improper operation of the elevator car door lock 402, as will be appreciated by those of skill in the art. The coupling element 408 and the lock element 410 are configured to operate independently of each other, as described herein. The lock element 410 is operably connected to a car door latch 418 that provides locking functionality for the elevator car door lock 402 (and an associated elevator car door). The lock element 410, in some embodiments, is arranged such that it remains in the locked position (shown in FIG. 4A) unless urged out of the locked state. That is, the locked position of the lock element 410 is achieved merely by the force of gravity, and thus the default state of the elevator car door lock 402 is in the locked state.

The landing door lock 404 shown in FIGS. 4A-4B is representative of one of a plurality of landing door locks that may be present in an elevator system, e.g., a landing door lock may be located at each landing along an elevator shaft. The landing door lock 404 includes a landing lock support 420 which can be affixed to a landing door sill or other frame structure, as will be appreciated by those of skill in the art. The landing door lock 404 includes a movable plate 422 that is movable or rotatable about a plate pivot 422*a* that provides movable mounting of the movable plate 422 to the landing lock support 420. The movable plate 422 has fixedly (and rotatably) mounted thereon a first contact element 424 and a second contact element 426. The movable plate 422, in this embodiment, further includes a landing door latch 428, which is operable to provide locking functionality for the elevator landing door lock 404 (and an associated elevator landing door).

The movable plate 422 is configured to move by application of force applied by the coupling element 408 of the elevator car door lock 402 to the first contact element 424. In operation, when the coupling element 408 of the elevator car door lock 402 is rotated by the first movable mounts 414, and the elevator car door lock 402 is located at the elevator landing door lock 404, the coupling element 408 will contact the first contact element 424 to urge the movable plate 422 to rotate. As the movable plate 422 is rotated, the second contact element 426 will contact the lock element 410 of the elevator car door lock 402. This operation will cause the lock element 410 to urge movement and operation of the car door latch 418, thus unlocking an associated elevator car door. Simultaneously, as the movable plate 422 is rotated, the landing door latch 428 will be operated to unlock an associated elevator landing door. This engagement, and the unlocked state, is shown in FIG. 4B, with the car door latch 418 and the landing door latch 428 shown in the unlocked/unlatched positions.

Also shown in FIGS. 4A-4B, each of the elevator car door lock 402 and the landing door lock 404 includes respective position sensors 430, 432. The position sensors 430, 432 are arranged to detect the position of the latches 418, 428. It is noted that receiving elements 430*a*, 432*a* of the position sensors 430, 432 are illustratively shown facing downward, with sensor contacts 430*b*, 432*b* pointing upward (shown in FIG. 4B). Thus, in operation the apertures within the receiving elements 430*a*, 432*a* will not collect dust or other debris, and thus degradation of operation of the position sensors 430, 432 may be avoided.

Figure 5A:
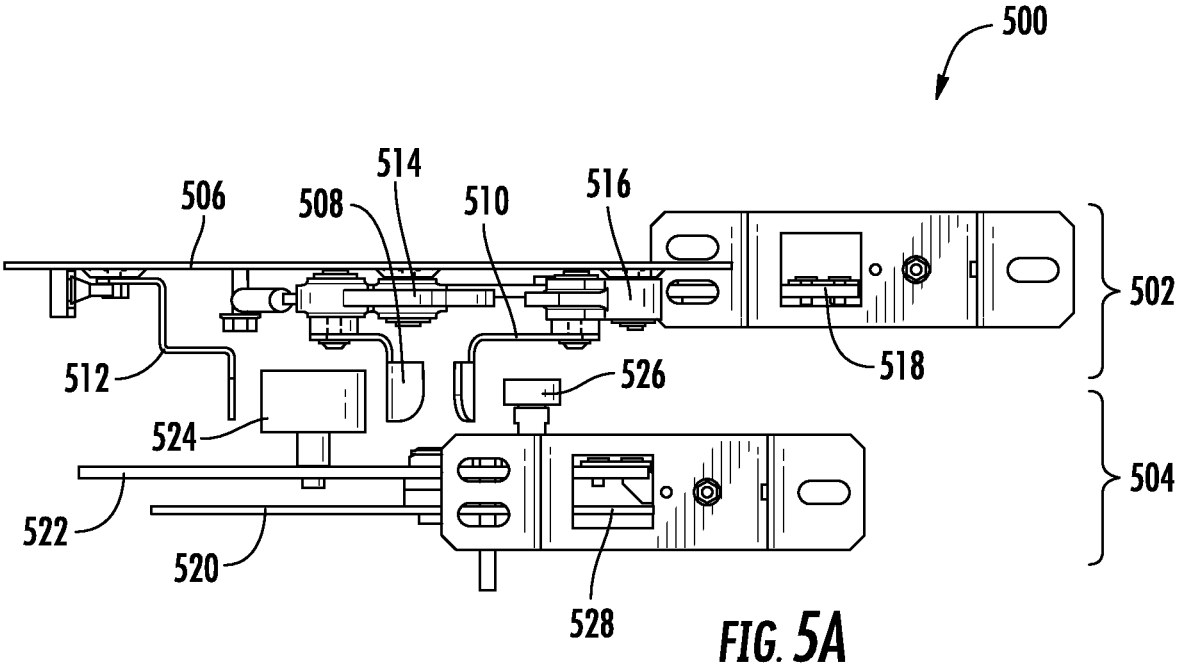
FIG. 5A is a schematic illustration of an elevator door coupling system in accordance with an embodiment of the present disclosure shown in a closed state.
Figure 5B:
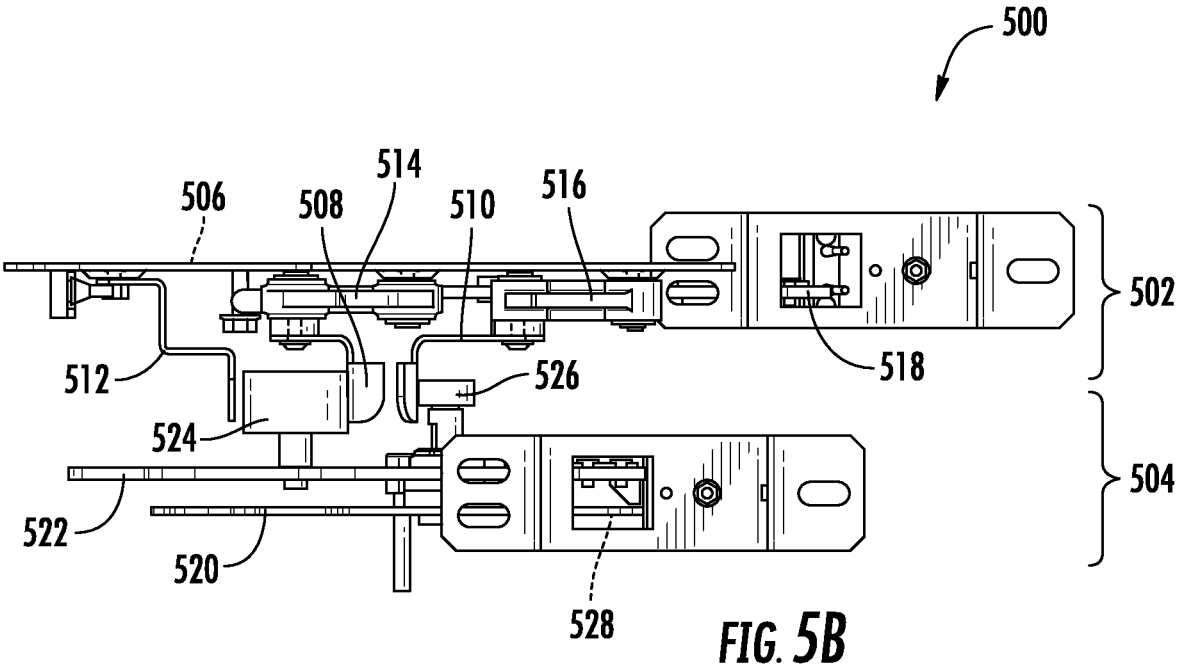
FIG. 5B is a schematic illustration of the elevator door coupling system of FIG. 5A in an open state.

Turning now to FIGS. 5A-5B, schematic illustrations of an elevator door coupling system 500 in accordance with an embodiment of the present disclosure are shown. The elevator door coupling system 500 is similar to that shown and described above with respect to FIGS. 4A-4B. The elevator door coupling system 500 includes an elevator car door lock 502 and a landing door lock 504. A car lock support 506 is configured to enable mounting of the elevator car door lock 502 to an elevator car. The landing door lock 504 may be mounted to and operably connected to a landing door by a landing lock support 520. FIG. 5A illustrates the elevator car door lock 502 and the landing door lock 504 in locked states (with the components separated from each other). FIG. 5B illustrates the elevator car door lock 502 engaged with the landing door lock 504 and in unlocked states. FIGS. 5A-5B are top-down plan views of the elevator door coupling system 500.

The elevator car door lock 502 includes a coupling element 508, a lock element 510, and a deterrent element 512. The coupling element 508 is moveable about one or more first movable mounts 514 and the lock element 510 is moveable about one or more second movable mounts 516, as described above. The coupling element 508 and the lock element 510 are configured to operate independently of each other, as described herein. The lock element 510 is operably connected to a car door latch 518 that provides locking functionality for the elevator car door lock 502 (and an associated elevator car door). The landing door lock 504 includes a landing lock support 520 with a movable plate 522 mounted thereto. The movable plate 522 has fixedly (and rotatably) mounted thereon a first contact element 524 and a second contact element 526. The movable plate 522 includes a landing door latch 528, which is operable to provide locking functionality for the elevator landing door lock 504 (and an associated elevator landing door).

The movable plate 522 is configured to move by application of force applied by the coupling element 508 of the elevator car door lock 502 to the first contact element 524, as shown in FIG. 5B. In operation, when the coupling element 508 of the elevator car door lock 502 is rotated by the first movable mounts 514, the coupling element 508 will contact the first contact element 524 to urge the movable plate 522 to rotate. As the movable plate 522 is rotated, the second contact element 526 will contact the lock element 510 of the elevator car door lock 502. This operation will cause the lock element 510 to urge movement and operation of the car door latch 518, thus unlocking an associated elevator car door. Simultaneously, as the movable plate 522 is rotated, the landing door latch 528 will be operated to unlock an associated elevator landing door.

Figure 6:
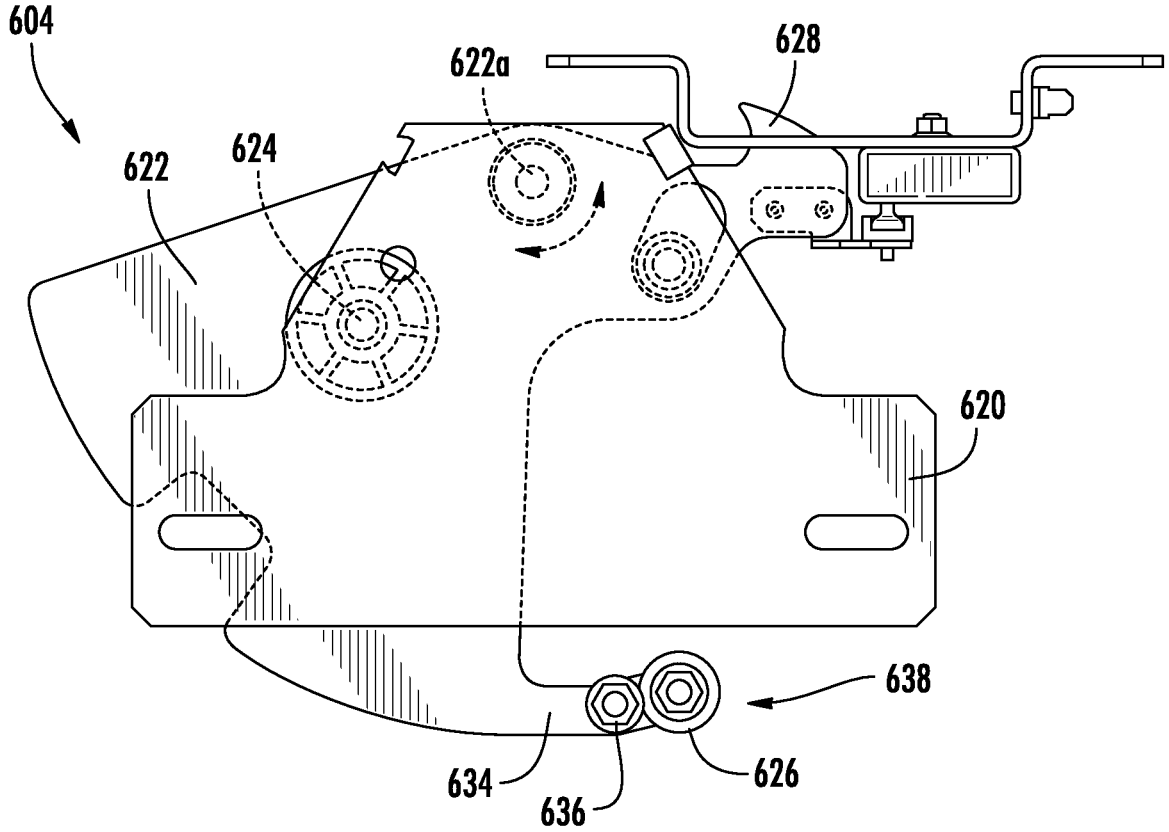
FIG. 6 is a schematic illustration of a landing door lock in accordance with an embodiment of the present disclosure.

Turning now to FIG. 6, a schematic illustration of a landing door lock 604 in accordance with an embodiment of the present disclosure is shown. The landing door lock 604 is representative of one of a plurality of landing door locks that may be present in an elevator system in accordance with an embodiment of the present disclosure. Each landing of an elevator shaft may include a landing door lock 604. The landing door lock 604 includes a landing lock support 620 which can be affixed to a landing door sill or other frame structure, as will be appreciated by those of skill in the art.

The landing door lock 604 includes a movable plate 622 that is movable or rotatable about a plate pivot 622*a*. The movable plate 622 has fixedly (and rotatably) mounted thereon a first contact element 624 and a second contact element 626. The movable plate 622 includes a landing door latch 628, which is operable to provide locking functionality for the elevator landing door lock 604 (and an associated elevator landing door). The first and second contact elements 624, 626 are configured to operate as described above. That is, the first (large) contact element 624 is configured to be engaged and urged by a coupling element of a car door lock and the second (smaller) contact element 626 is configured to apply force to a lock element of the same car door lock due to movement of the movable plate 622 about the plate pivot 622*a*.

As shown, the movable plate 622 includes an extension arm 634. The extension arm 634 includes an unlocking screw 636 and the second contact element 626. The unlocking screw 636 is arranged to enable unlocking of the landing door from the landing (e.g., using a triangular key) as will be appreciated by those of skill in the art. The second contact element 626 is arranged on an end 638 of the extension arm 634, with the extension arm 634 enabling positioning of the second contact element 626 relative to the lock element of a car door lock, as shown and described above.

Advantageously, embodiments described herein provide elevator door coupling systems that are configured to prevent the car door from being opened outside of the door zone and allow for the elimination of elements located within the elevator shaft, thus reducing the amount of space occupied by various elevator system components and elements. Further, due to the default state of the lock element, elevator door coupling systems of the present disclosure do not need electrical actuators and/or complex mechanical parts for operation.

Advantageously, and as will be apparent from the above description and illustrations, a position of the elevator car door lock and/or the landing door lock can be monitored with receiving elements of position sensors oriented face down. By orienting the electrical contacts of the receiving elements face down, dust or other particles or debris may not be able to fall into and interfere with operation of the position sensors. Moreover, in some such embodiments, a compression spring for operation of the position sensor(s) may be eliminated, due to the orientation of the position sensor(s) and the other features of embodiments described herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator door coupling system comprising:

a car door lock having a coupling element and a lock element, the lock element operably connected to a latch for locking the car door lock; and a landing door lock having a movable plate having an extension arm, a first contact element mounted to the movable plate and configured to engage with the coupling element and a second contact element located on the extension arm and configured to engage with the lock element, wherein, in operation, the coupling element is operable to apply force to the first contact element and cause the movable plate to rotate and as the movable plate rotates, the second contact element applies force to the lock element to urge the latch from a locked position to an unlocked position;

an unlocking screw located on the extension arm, and a car lock support, wherein the coupling element is pivotably mounted to the car lock support by at least one first movable mount and the lock element is pivotably mounted to the car lock support by at least one second movable mount, and a deterrent element fixedly connected to the car lock support and arranged to prevent unauthorized or improper operation of the car door lock.

2. The elevator door coupling system of claim 1, the landing door lock further comprising a landing door latch for locking the landing door lock.

3. The elevator door coupling system of claim 1, further comprising at least one position sensor operably connected to at least one of the car door lock and the landing door lock.

4. The elevator door coupling system of claim 1, wherein the first contact element is a first roller and the second contact element is a second roller.

5. The elevator door coupling system of claim 4, wherein the first roller is larger than the second roller.

6. The elevator door coupling system of claim 1, wherein the lock element is maintained in a locked state by operation of gravity unless acted upon by the second contact element.

7. The elevator door coupling system of claim 1, further comprising a landing lock support, wherein the landing door lock is mounted to the landing lock support, and the landing lock support is mountable to a frame of a landing door of an elevator system.

8. An elevator system comprising:

an elevator car located within an elevator shaft;

a landing having a landing door openable on the elevator shaft; and an elevator door coupling system comprising:

a car door lock having a coupling element and a lock element, the lock element operably connected to a latch for locking the car door lock; and a landing door lock having a movable plate having an extension arm, a first contact element mounted to the movable plate and configured to engage with the coupling element and a second contact element located on the extension arm and configured to engage with the lock element, wherein, in operation, the coupling element is operable to apply force to the first contact element and cause the movable plate to rotate and as the movable plate rotates, the second contact element applies force to the lock element to urge the latch from a locked position to an unlocked position;

an unlocking screw located on the extension arm, and a car lock support, wherein the coupling element is pivotably mounted to the car lock support by at least one first movable mount and the lock element is pivotably mounted to the car lock support by at least one second movable mount, and a deterrent element fixedly connected to the car lock support and arranged to prevent unauthorized or improper operation of the car door lock.

9. The elevator system of claim 8, wherein the elevator shaft comprises a plurality of additional landings, wherein each additional landing comprises a respective landing door lock.

10. The elevator system of claim 8, the landing door lock further comprising a landing door latch for locking the landing door lock.

11. The elevator system of claim 8, further comprising at least one position sensor operably connected to at least one of the car door lock and the landing door lock.

12. The elevator system of claim 8, wherein the first contact element is a first roller and the second contact element is a second roller.

13. The elevator system of claim 8, wherein the lock element is maintained in a locked state by operation of gravity unless acted upon by the second contact element.

* * * * *